US006860179B2

(12) United States Patent
Hopper et al.

(10) Patent No.: US 6,860,179 B2
(45) Date of Patent: Mar. 1, 2005

(54) CLAMP DEVICE

(75) Inventors: Ryan K. Hopper, Lincoln, NE (US); Walter J. Sedlacek, West Chicago, IL (US); Daniel L. Poole, Phoenix, AZ (US); Robert N. Poole, Phoenix, AZ (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 10/162,528

(22) Filed: Jun. 3, 2002

(65) Prior Publication Data

US 2003/0005797 A1 Jan. 9, 2003

Related U.S. Application Data

(60) Continuation of application No. 29/136,810, filed on Feb. 7, 2001, now Pat. No. Des. 473,776, which is a division of application No. 09/451,580, filed on Nov. 30, 1999.

(60) Provisional application No. 60/132,266, filed on May 3, 1999.

(51) Int. Cl.[7] ..... B25B 7/00

(52) U.S. Cl. ..... 81/318; 81/319; 81/324; 81/328

(58) Field of Search ..... 81/318, 319, 320, 81/324, 325, 328; 24/489, 517, 519

(56) References Cited

U.S. PATENT DOCUMENTS

| | | | | | |
|---|---|---|---|---|---|
| 382,712 | A | * | 5/1888 | Marr | 7/134 |
| 838,514 | A | | 12/1906 | Baker | |
| 1,162,059 | A | | 11/1915 | Hersey | |
| 1,189,561 | A | * | 7/1916 | Griminger | 81/320 |
| 1,519,210 | A | | 12/1924 | McGuckin | |
| 1,551,328 | A | | 3/1925 | Perry | |
| 1,772,428 | A | | 8/1930 | Palotce | |
| 1,879,452 | A | | 9/1932 | Palotce | |
| 1,882,095 | A | | 10/1932 | Reggitts | |
| 1,944,116 | A | | 1/1934 | Stratman | |
| 2,386,570 | A | | 10/1945 | Petrie | |
| 2,439,785 | A | * | 4/1948 | Feitl et al. | 29/229 |
| 2,539,865 | A | | 1/1951 | Sarvie | |
| 2,595,989 | A | | 5/1952 | Smeltz | |
| 2,620,697 | A | | 12/1952 | Sarvie | |
| 2,635,496 | A | * | 4/1953 | Marasco | 81/328 |

(List continued on next page.)

OTHER PUBLICATIONS

Brochure, "Sample of Customer Presentation on New Clamp", American Tool Companies, Inc., New Product Meeting, Jun. 1, 2000, 15 pages.

*Primary Examiner*—M. Rachuba
(74) *Attorney, Agent, or Firm*—Dennis J. Williamson; Moore & VanAllen, PLLC

(57) ABSTRACT

A clamp device is disclosed having a first member having a handle portion and a jaw portion. A second member has a handle portion and a jaw portion. The handle portion and jaw portion of the second member define a notch extending from an inner surface of the handle portion of the second member at least partially into the jaw portion of the second member, the second member being formed as a single piece. A pivot is pivotally coupling the first member and the second member intermediate their respective handle portion and jaw portion for opposed pivotal motion. An arcuate clamp bar has a first end coupled to the first member and a second end, an arc of the arcuate clamp bar being concentric with the pivot. A brake lever has an end pivotally coupled to the second member at the notch. The end contacts the jaw portion of the second member. The brake lever has an aperture with the arcuate clamp bar extending therethrough. The brake lever is movable laterally between a frictionally engaged position, frictionally engaging the arcuate clamp bar and a disengaged position.

42 Claims, 12 Drawing Sheets

U.S. PATENT DOCUMENTS 2,701,487 A 2/1955 Ortman
3,313,190 A 4/1967 Bothum
3,470,872 A * 10/1969 Grieshaber ..... 600/217
3,608,404 A 9/1971 Sarvie
3,779,108 A 12/1973 Reiter
4,538,485 A 9/1985 Saila
4,802,390 A 2/1989 Warheit
4,896,661 A * 1/1990 Bogert et al. ..... 606/86
4,923,340 A 5/1990 Hegedusch
5,275,391 A 1/1994 Lynn et al.
5,281,058 A 1/1994 Hill
5,284,331 A 2/1994 Lee et al.
D348,816 S 7/1994 Degen
5,591,176 A 1/1997 Henderson et al.
5,674,244 A 10/1997 Mathys
5,681,034 A 10/1997 Noniewicz
5,681,134 A 10/1997 Ebert
5,695,304 A 12/1997 Ebert
D392,866 S 3/1998 Degen et al.
5,791,210 A 8/1998 Wolff et al.
5,954,460 A 9/1999 Degen et al.
D417,377 S 12/1999 Blank et al.
D430,782 S 9/2000 Renner
6,116,124 A * 9/2000 Ping ..... 81/385
6,199,458 B1 * 3/2001 Wrigley et al. ..... 81/319
6,308,597 B1 * 10/2001 Stahle ..... 81/319

* cited by examiner

CLAMP DEVICE

RELATED APPLICATIONS

This application is a continuation of and claims the benefit of U.S. application Ser. No. 29/136,810, filed Feb. 7, 2001 D, 473776, which in turn claims the benefit of U.S. application Ser. No. 09/451,580, filed Nov. 30, 1999, which in turn claims the benefit of Provisional Application Ser. No. 60/132,266, filed May 3, 1999, all of which are incorporated herein by reference in their entirety.

BACKGROUND OF THE INVENTION

This invention relates generally to clamping devices, and more particularly to clamping devices which can be manipulated with one hand.

Clamping devices are well known and have been in use for many years. Particularly, straight bar friction locking clamps are extremely popular. These clamp devices can be operated one handed, and are very effective. The problem with these devices is that they operate in a linear fashion, with the clamping jaws sliding directly toward and away from one another. This structure presents some limitations such as limiting access of the clamp in tight spots, etc.

Often, pliers are used to clamp items together because the motion of the handles permits their use in closer spaces. The problem with pliers is that the user must maintain the pressure on the handles, as they do not remain locked in position. Locking pliers using friction locks have been introduced, but while they will lock into a specific configuration, they will not clamp unless the material to be clamped is resilient. When rigid items are to be clamped, the clamping jaws will close to the surface of the item but will not hold it securely.

Accordingly, it would be highly desirable to provide an improved clamp device.

It is a purpose of the present invention to provide a clamp device which can be operated with one hand.

It is another purpose of the present invention to provide a clamp device which will securely hold a rigid item.

It is still another purpose of the present invention to provide a clamp device with a release trigger which remains in position.

It is a further purpose of the present invention to provide a clamp device which can be operated in confined spaces.

BRIEF SUMMARY OF THE INVENTION

A clamp device is disclosed herein. According to one aspect of the invention, the clamp device includes a first member having a handle portion and a jaw portion. A second member has a handle portion and a jaw portion. The handle portion and jaw portion of the second member define a notch extending from an inner surface of the handle portion of the second member at least partially into the jaw portion of the second member. The second member is formed as a single piece. A pivot is pivotally coupling the first member and the second member intermediate their respective handle portion and jaw portion for opposed pivotal motion. An arcuate clamp bar has a first end coupled to the first member and a second end. An arc of the arcuate clamp bar is concentric with the pivot. A brake lever has an end pivotally coupled to the second member at the notch. The end contacts the jaw portion of the second member. The brake lever has an aperture with the arcuate clamp bar extending therethrough. The brake lever is movable laterally between a frictionally engaged position, frictionally engaging the arcuate clamp bar and a disengaged position.

According to another aspect of the invention, the clamp device includes a first member having a handle portion and a jaw portion. A second member has a handle portion and a jaw portion. The handle portion and the jaw portion of the second member define a notch extending from an inner surface of the handle portion of the second member at least partially into the jaw portion of the second member. The notch has inner surfaces integral with the second member. A pivot is pivotally coupling the first member and the second member intermediate their respective handle portion and jaw portion for opposed pivotal motion. An arcuate clamp bar has a first end coupled to the first member and a second end. An arc of the arcuate clamp bar is concentric with the pivot. A brake lever has an end pivotally disposed within the notch. The brake lever pivots against an inner surface of the notch in the jaw portion of the second member and has an aperture with the arcuate clamp bar extending therethrough. The brake lever is movable laterally between a frictionally engaged position, frictionally engaging the arcuate clamp bar and a disengaged position, and substantially motionless longitudinally.

According to another aspect of the invention, the clamp device includes a first member having a handle portion and a jaw portion. The jaw portion includes a first upper member and a first truncated member each having an inner wall and a first shoulder defined by the inner wall of the first upper member and adjacent the first truncated member. A second member has a handle portion and a jaw portion. The jaw portion includes a second upper member and a second truncated member each having an inner wall and a second shoulder defined by the inner wall of the second upper member and adjacent the second truncated member. A first recess is defined by the inner wall of the first truncated member and the first shoulder. The first recess is for receiving the second truncated member such that the second truncated member is substantially flush with the first upper member. A second recess is defined by the inner wall of the second truncated member and the second shoulder. The second recess is for receiving the first truncated member such that the first truncated member is substantially flush with the second upper member. A pivot is pivotally coupling the first member and the second member intermediate their respective handle portion and jaw portion for opposed pivotal motion. An arcuate clamp bar has a first end coupled to the first member and a second end. An arc of the arcuate clamp bar is concentric with the pivot. A brake lever has an end contacting the second truncated member and has an aperture with the arcuate clamp bar extending therethrough. The brake lever is movable laterally between a frictionally engaged position engaging the arcuate clamp bar and a disengaged position.

According to another aspect of the invention, the clamp device includes a first member having a handle portion and a jaw portion, the jaw portion including a first upper member having an inner wall, an outer wall and a web wall that extends along at least a portion of the first upper member. The inner wall, the outer wall and the web wall define hollow portions in the first upper member. A second member has a handle portion and a jaw portion. The jaw portion includes a second upper member having an inner wall, an outer wall and a web wall that extends along at least a portion of the second upper member. The inner wall, the outer wall and the web wall define hollow portions in the second upper member. A pivot is pivotally coupling the first member and the second member intermediate their respective handle portion and jaw portion for opposed pivotal motion. An arcuate clamp bar has a first end coupled to the first member. The arcuate clamp bar is concentric with the pivot. A brake lever has an end contacting the jaw portion of the second member and has an aperture with the arcuate clamp bar extending therethrough. The brake lever is movable laterally between a frictionally engaged position engaging the arcuate clamp bar and a disengaged position.

The invention also includes a method for operating a bar clamp. The clamp bar has a pair of pivotally attached handles and jaws that are movable from a fully open to a fully closed position and therebetween. A brake lever is associated with one of the handles. The bar clamp has a clamp bar and at least the brake lever engages the clamp bar. The method includes squeezing with one hand the pair of handles and ceasing the squeezing of the handles before the fully open position is reached. The brake lever is moved with the one hand towards the handle associated with the brake lever, such that the pair of jaws returns towards a fully open position.

Another aspect of the method includes clamping a workpiece with a bar clamp having a pivotally attached pair of handles and jaws. One of the handles has a brake lever associated with it. The bar clamp has a clamp bar and at least the brake lever engaging the clamp bar. The method includes squeezing with one hand the pair of handles until the jaws engage the workpiece. The one hand squeezes the pair of handles so that the jaws exert a force on the workpiece and retain the jaws in position relative to the workpiece.

Another aspect of the method includes moving a bar clamp in incremental amounts. The bar clamp has a pivotally attached pair of handles and jaws. One of the handles has a brake lever associated with it. The handle is biased towards a fully open position. The bar clamp has a clamp bar and at least the brake lever engages the clamp bar. The method includes using one hand to squeeze the pair of handles such that a pair of jaws moves towards a fully closed position an incremental amount. The squeezing of the handles is then ceased. The pair of handles is then squeezed such that the pair of jaws moves towards the fully closed position at least the same incremental amount. The squeezing of the handles is then ceased. The brake lever is moved with the one hand to disengage the clamp bar to release the jaws from the fully closed position. Another aspect of the method includes operating a hand clamp to engage a workpiece. The hand clamp has a pair of opposed, pivotally connected members. Each of the members has a jaw portion and a gripping portion. The hand clamp has a clamp bar for engagement by a brake lever associated with one of the members. The method includes holding the opposed gripping portions of the clamp using a single hand. The jaw portions are placed at least partially around the workpiece. The gripping portions are squeezed toward each other using the single hand. The squeezing of the gripping portions causes movement of the opposed jaw portions toward the workpiece. A sufficient force is applied to the gripping portions to engage the workpiece with the jaw portions of the clamp. The single hand is then released from the clamp.

BRIEF DESCRIPTION OF SEVERAL VIEWS OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE INVENTION

Figure 1:
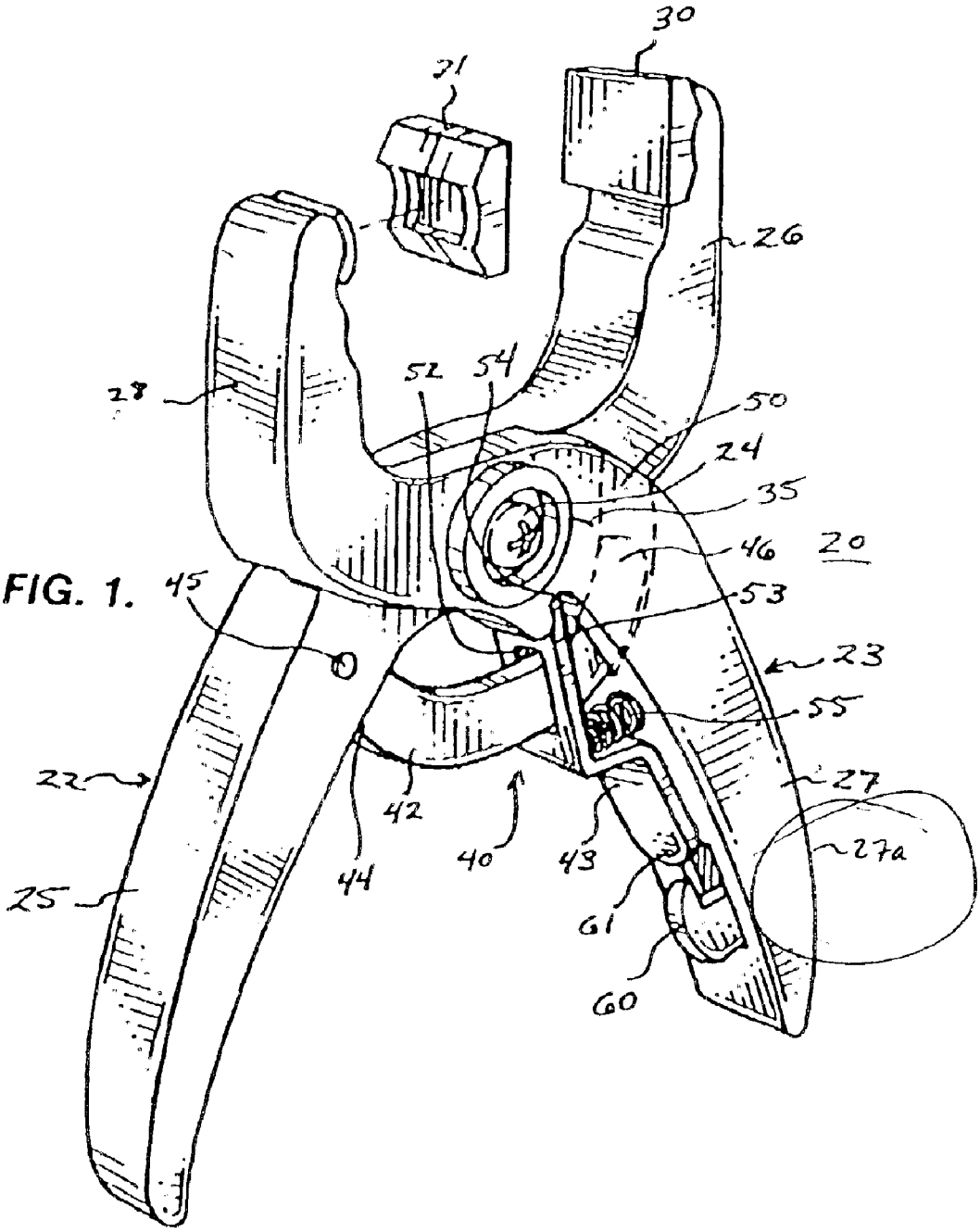
FIG. 1 is a perspective view of a clamp device in accordance with the present invention, hidden portions illustrated in broken lines for clarity.
Figure 2:
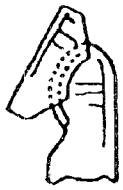
FIG. 2 is a plan view of a snap-fit jaw portion broken away to illustrate pivotal movement.

Turning now to the drawings in which like reference characters indicate corresponding elements throughout the several views, attention is first directed to FIG. 1, which illustrates a clamp device generally designated 20. Clamp device 20 includes a pair of members 22, 23 pivotally connected by a pivot 24 (bolt, rivet, screw, etc.) for pivotal opposed operation (i.e. scissors like motion). Member 22 includes a handle portion 25 and a jaw portion 26. Similarly, member 23 includes a handle portion 27 and a jaw portion 28. The distal end of jaw portion 26 has a snap-fit gripping member 30 pivotally coupled thereto (see FIG. 2 for pivotal action). The distal end of jaw portion 28 has a snap-fit gripping member 31 pivotally coupled thereto (illustrated in an unsnapped position for clarity). Included in this embodiment is an optional spring 35 which is carried by pivot 24 with outwardly extending ends which engage handle portions 25, 27 to bias clamp device 20 into the open position illustrated in FIG. 1. Spring 35 can be omitted allowing clamp device 20 to be operated similar to conventional pliers with manual opening and closing.

Figure 3:
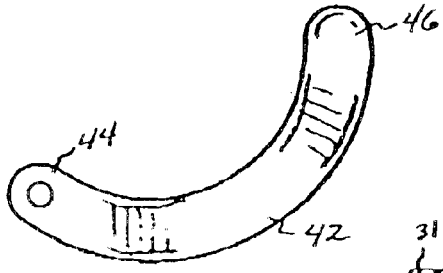
FIG. 3 is a plan view of a clamp bar of the clamp device of FIG. 1.
Figure 4:
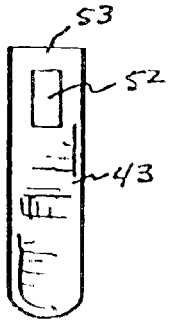
FIG. 4 is a side elevational view of a brake lever of the clamp device of FIG. 1.

In accordance with the present invention, clamp device 20 further has a locking assembly 40 including a clamp bar 42 and a brake lever 43. Clamp bar 42 is an elongate arcuate design (see FIG. 3) with a coupled end 44 pivotally attached to handle portion 25 by a roll pin 45 (or any convenient mechanism to allow limited movement) permitting relative pivotal movement. A free end 46 of clamp bar 42 extends unhindered through or adjacent to handle portion 27, allowing free relative movement of handle portions 25, 27. It should be understood that clamp bar 42 can be received in a groove or aperture 50 formed in handle portion 27. It should also be understood that clamp bar 42 has an arcuate shape to correspond to the pivotal movement of elements 22, 23, and is positioned to be substantially parallel to pivot 24, i.e. the arc of clamp bar 42 is concentric with pivot 24. However, slight variation will still operate.

Figure 5:
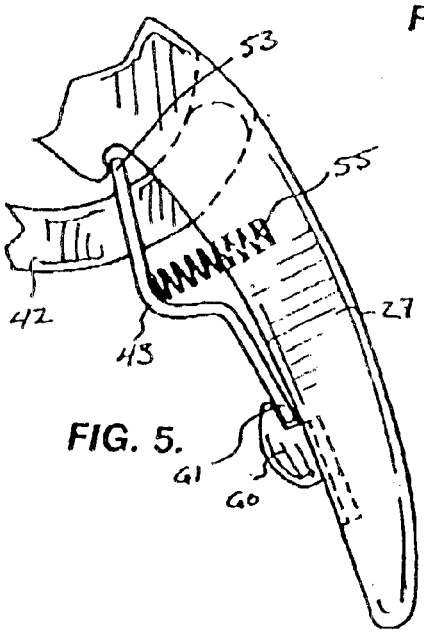
FIG. 5 is a plan view of the clamp device of FIG. 1 with the brake lever in an inoperative mode, portions thereof broken away.
Figure 6:
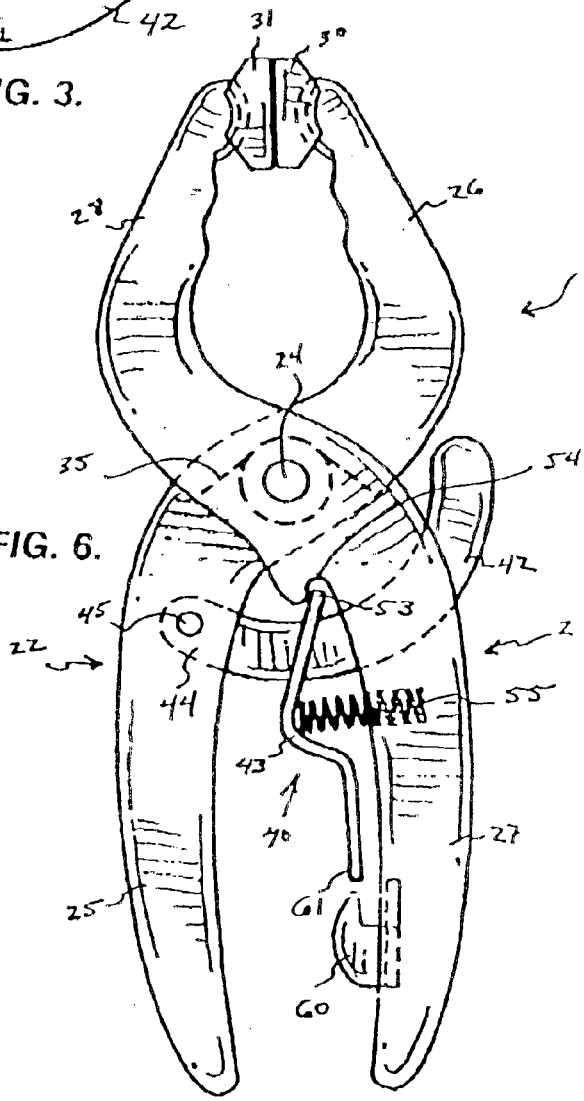
FIG. 6 is a plan view of the clamp device of FIG. 1 as it appears in the closed position, hidden portions illustrated in broken lines for clarity.

Brake lever 43 has an aperture 52 formed therethrough proximate a pivotal end 53. Clamp bar 42 is slidably received through aperture 52 with pivotal end 53 of brake lever 43 pivotally engaged in a notch 54 formed proximate pivot 24. A compression spring 55 is positioned between brake lever 43 and handle portion 27 so as to bias brake lever 43 outwardly away from handle portion 27 and frictionally engage clamp bar 42 at aperture 52. Brake lever 43 is moveable between a frictionally engaged (locking) position and a disengaged position. In the frictionally engaged position brake lever 43 frictionally engages clamp bar 42 preventing movement thereof and thereby preventing opening of clamp device 20 without preventing the closing thereof, i.e. locking assembly 40 prevents clamp device 20 from opening but allows it to be closed or clamped to an object. Here it should be noted that spring 55 normally biases brake lever 43 into the frictionally engaged (locked) position (as illustrated in FIG. 1). In the disengaged position brake lever 43 has been moved toward handle portion 27 against the bias of spring 55 removing the frictional engagement between brake lever 43 and clamp bar 42, permitting clamp bar 42 to move freely through aperture 52. Thus, clamp device 20 can be opened. A latch 60 is slidably mounted in handle portion 27 so as to be selectively engagable with a free end 61 of brake lever 43, holding brake lever 43 in the disengaged position (see FIG. 5) and able to operate as conventional pliers. Turning to FIG. 6, clamp device 20 is shown in a closed position. Because the curvature of clamp bar 42 is concentric with pivot 24, brake lever 43 does not move longitudinally. This permits the use of latch 60 and aperture 52 more closely sized to match the width of clamp bar 42.

Referring now to FIGS. 7–10, another embodiment of clamp device generally designated 120 is illustrated. Clamp device 120 includes a pair of members 122, 123 pivotally connected by a pivot 124 (bolt, rivet, screw, etc) for pivotal opposed operation (i.e. scissors like motion). Member 122 includes a handle portion 125 and a jaw portion 126. Similarly, member 123 includes a handle portion 127 and a jaw portion 128. The distal end of jaw portion 126 preferably has a snap-fit gripping member 130 pivotally coupled thereto although this may be omitted. The distal end of jaw portion 128 has a snap-fit gripping member 131 pivotally coupled thereto although this may be omitted if gripping member 130 is omitted. Included in this embodiment is an optional spring 135 which is carried by pivot 124 with outwardly extending ends which engage handle portions 125, 127 to bias clamp device 120 into the open position illustrated in FIG. 10. Spring 135 can be omitted allowing clamp device 120 to be operated similar to conventional pliers with manual opening and closing.

In accordance with the present invention, clamp device 120 further has a locking assembly 140 including a clamp bar 142 and a brake lever 143. Clamp bar 142 is an elongate arcuate design (see FIG. 8) with a coupled end 144 pivotally attached to handle portion 125 by a roll pin 145 (or any convenient mechanism to allow limited movement) permitting relative pivotal movement to insure concentricity of the arc to pivot 124. A free end 146 of clamp bar 142 extends unhindered through or adjacent to handle portion 127, allowing free relative movement of handle portions 125, 127. In this specific embodiment, handle portion 127 is hollow, and a pair of parallel spaced apart roll pin guides 156 contained therein receive clamp bar 142 slidably therebetween. In this fashion, instead of clamp bar 142 extending beyond the handle in the closed position it is contained within the hollow and thickened handle portion 127.

Figure 7:
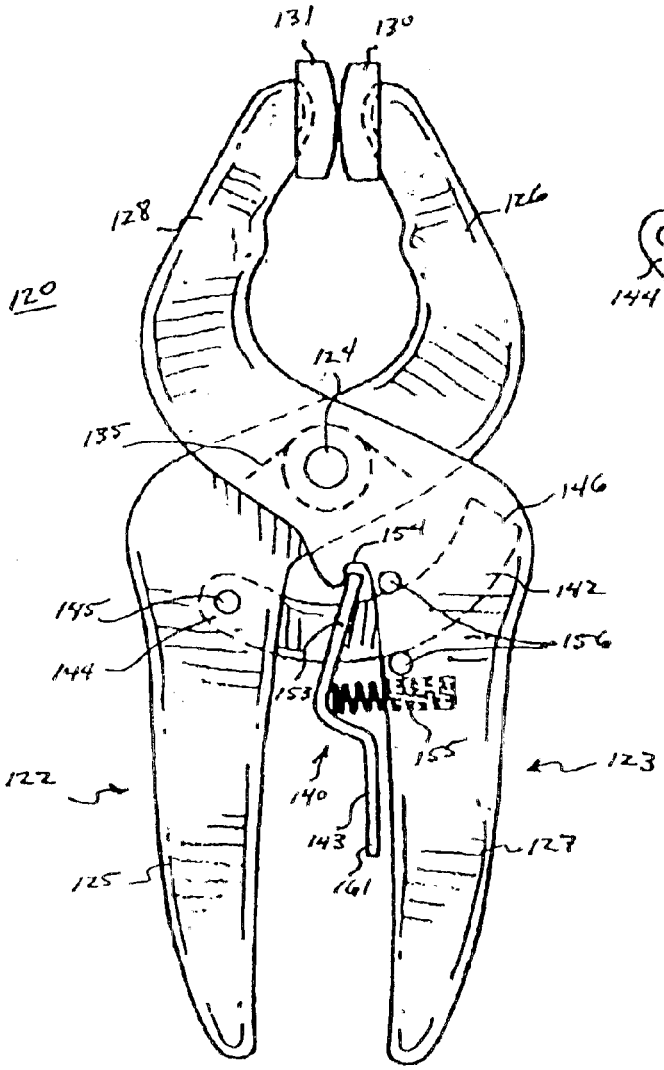
FIG. 7 is a plan view of another embodiment of a clamp device in the closed position according to the present invention, hidden portions illustrated in broken lines for clarity.
Figure 8:
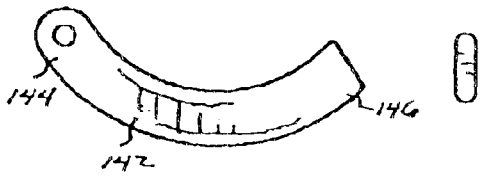
FIG. 8 is a plan view of a clamp bar of the clamp device of FIG. 7.
Figure 9:
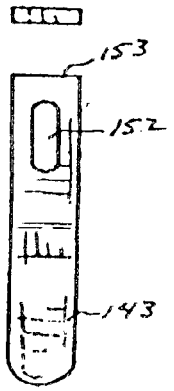
FIG. 9 is a side elevational view of a brake lever of the clamp device of FIG. 7.
Figure 10:
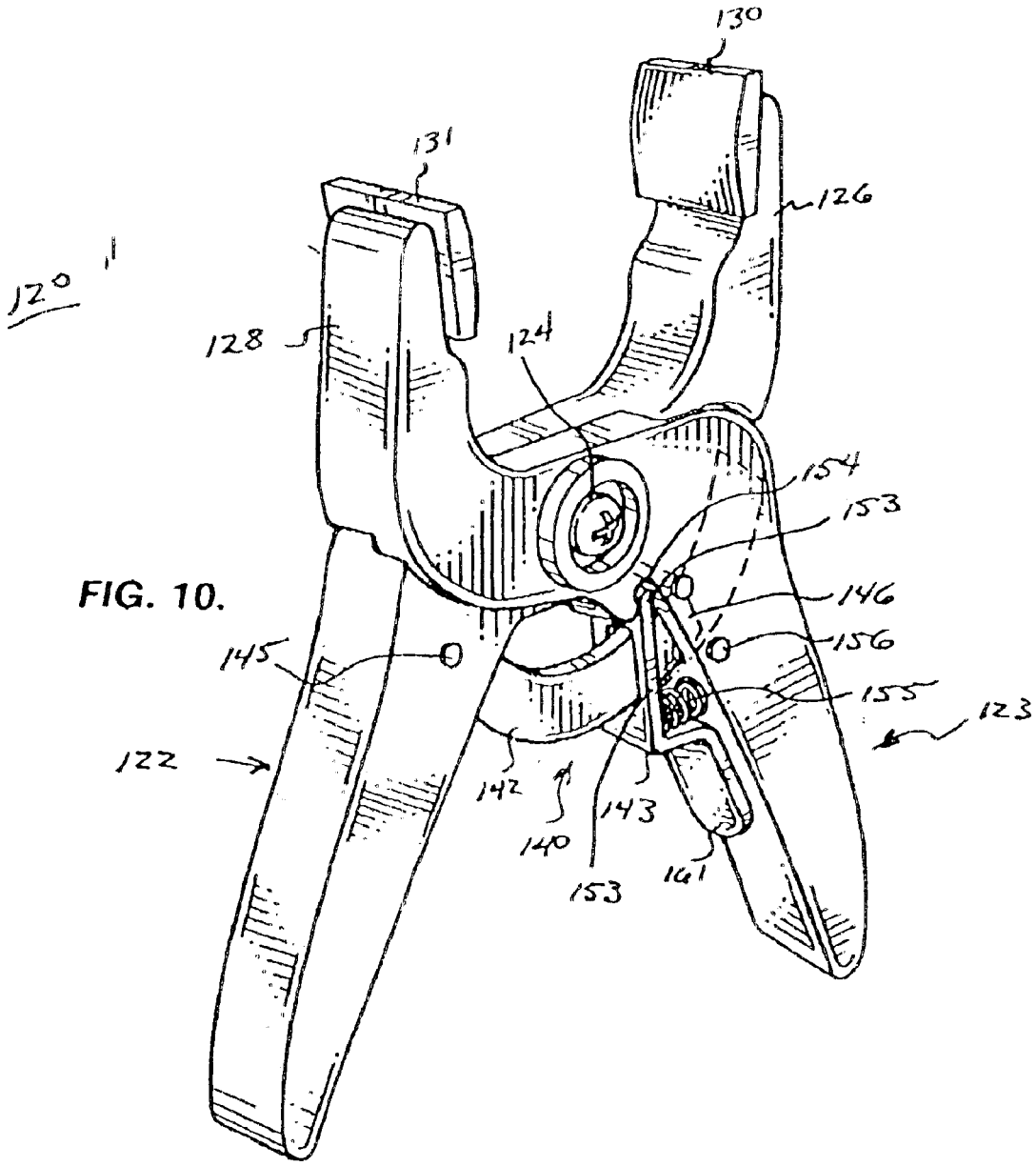
FIG. 10 is a perspective view of the clamp device of FIG. 7 as it appears in an open position, hidden portions illustrated in broken lines for clarity.

Brake lever 143 has an aperture 152 formed therethrough proximate a pivotal end 153. In this embodiment, aperture 153 has rounded ends which correspond to rounded edges of clamp bar 142. This provides greater frictional engagement therebetween. Clamp bar 142 is slidably received through aperture 152 with pivotal end 153 of brake lever 143 pivotally engaged in a notch 154 formed proximate pivot 124. A compression spring 155 is positioned between brake lever 143 and handle portion 127 so as to bias brake lever 143 outwardly away from handle portion 127 and frictionally engage clamp bar 142 at aperture 152. Brake lever 143 is moveable between a frictionally engaged (locking) position and a disengaged position. In the frictionally engaged position brake lever 143 frictionally engages clamp bar 142 preventing movement thereof and thereby preventing opening of clamp device 120. Here it should be noted that spring 155 normally biases brake lever 143 into the frictionally engaged position (as illustrated in FIGS. 7 and 10). In the disengaged position brake lever 143 has been moved toward handle portion 127 against the bias of spring 155 permitting clamp bar 142 to move freely through aperture 152. While a latch is not shown in this embodiment, it is optional in all embodiments.

In each of the previously described embodiments, clamp devices 20 and 120 are preferably formed of a flexible material such as plastic. While rigid materials such as metal may be employed, the clamping operation will not be as effective unless the metal is flexible. By flexing in an outward direction under pressure from the item being clamped, the jaw portions of members 22, 23 of device 20 and members 122, 123 of device 120 form a tension system which permits a tight clamping action by their bias in the inward direction. In the same manner, the handle portions of the members flex in an inward direction as compression is applied, and bias outwardly upon release of the compression force, placing pressure upon the jaw portions.

Figure 11:
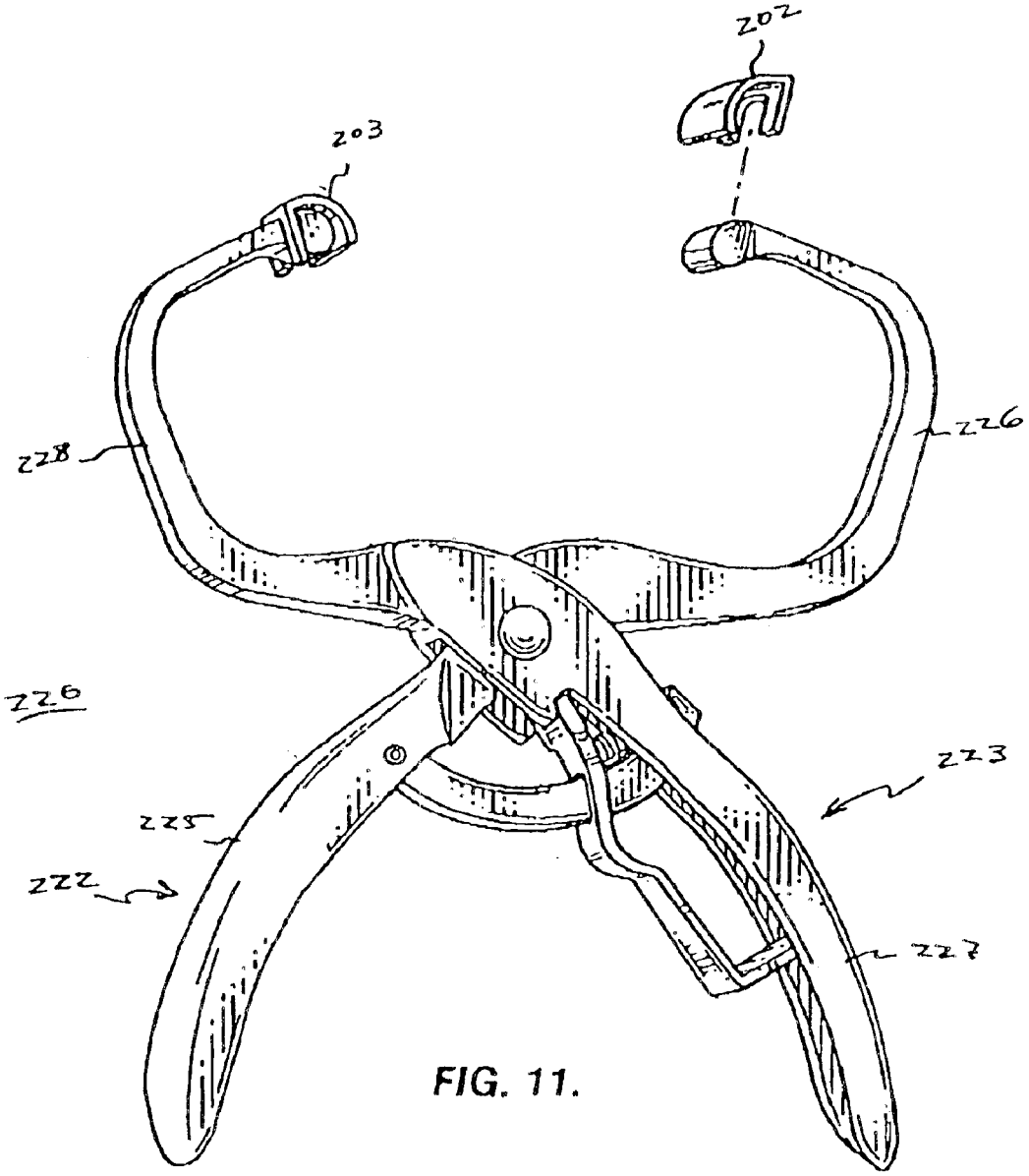
FIG. 11 is a perspective view of another embodiment of a clamp device according to the present invention.

Turning now to FIG. 11, a further embodiment of a clamp device generally designated 220 is illustrated. Device 220 is substantially similar to devices 20 and 120, and in fact can be identical with the addition of clip springs 202, 203 attached to members 222, 223, respectively, at the distal ends of jaw portions 226, 228 respectively. Thus, members 222, 223 can be formed of a rigid material such as steel having no flex, with the flex provided by spring clips 202, 203. In this manner a tension system providing a strong clamping action is achieved. However, in this embodiment, clips 202, 203 can be removed. Clamp device 220 can be constructed of a resilient and flexible material such as spring steel. In this manner, jaw portions 226, 228 can form a tension system as previously described. Furthermore, members 222, 223 include handle portions 225, 227, respectively. Handle portions 225, 227 can also be formed of a flexible and resilient material. To enhance the flexibility, the handles can be hollowed as shown. This provides the flexibility and shape memory required to form a tension system as described previously.

Figure 12:
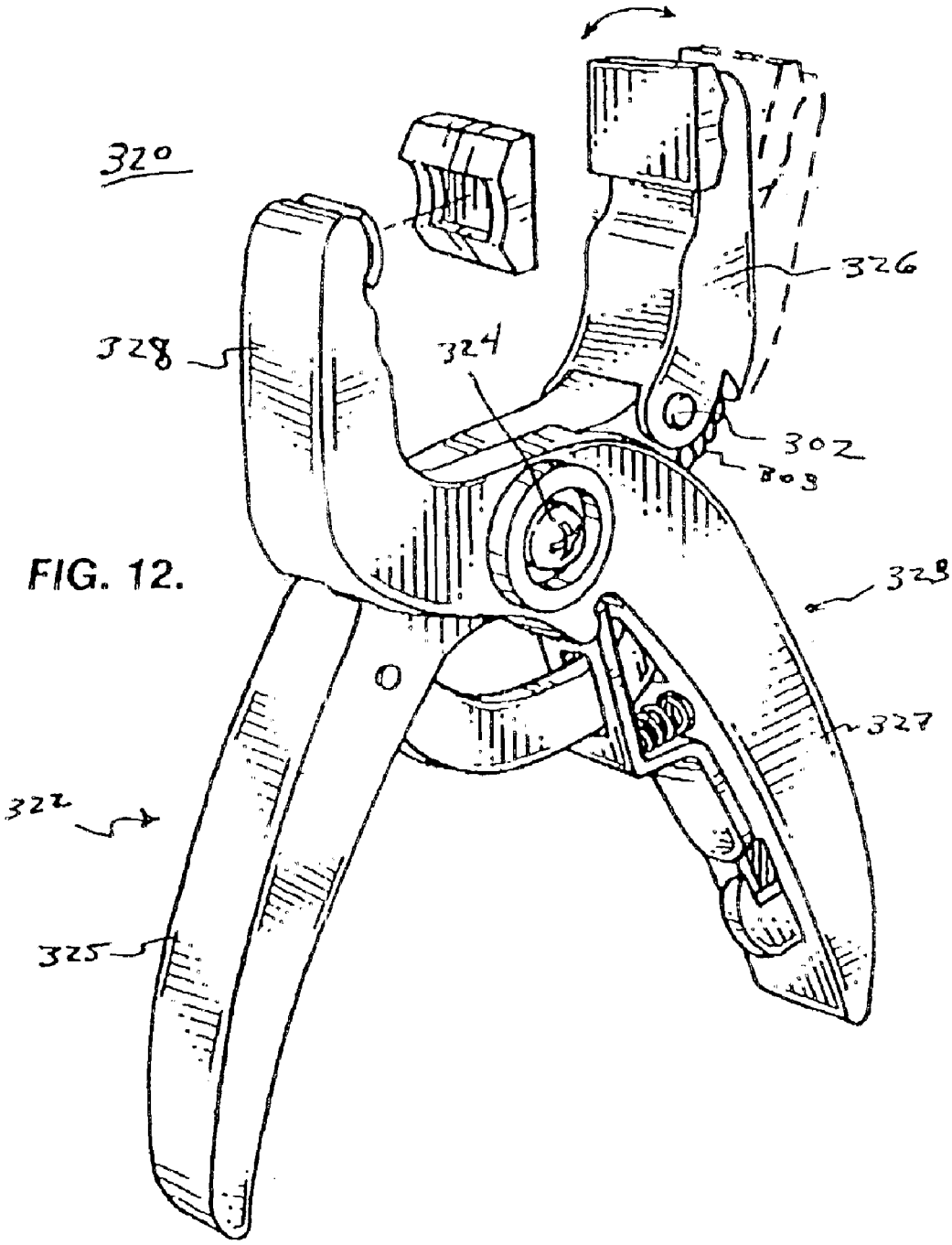
FIG. 12 is a perspective view of yet another embodiment of a clamp device according to the present invention.

Referring to FIG. 12, another embodiment of a clamping device generally designated 320 is illustrated. Again, device 320 is substantially identical to the previously described embodiments, including a pair of members 322, 323 pivotally connected by a pivot 324 (bolt, rivet, screw, etc) for pivotal opposed operation (i.e. scissors like motion). Member 322 includes a handle portion 325 and a jaw portion 326. Similarly, member 323 includes a handle portion 327 and a jaw portion 328. A flex in members 322, 323 is provided by a pivot joint 302 formed in jaw portion 326. The slight pivot is biased by compression spring 303 carried at pivot joint 302 to force the distal ends of jaw portions 326, 328 toward one another in an inward direction. During a clamping operation, as jaw portions 326, 328 are brought toward one another into contact with an item to be clamped, the terminal ends are moved outward against the bias of spring 303 bringing the whole structure under tension and forming a strong clamping action. It should be understood that a pivot joint and compression spring can also be installed on jaw portion 328.

Figure 13:
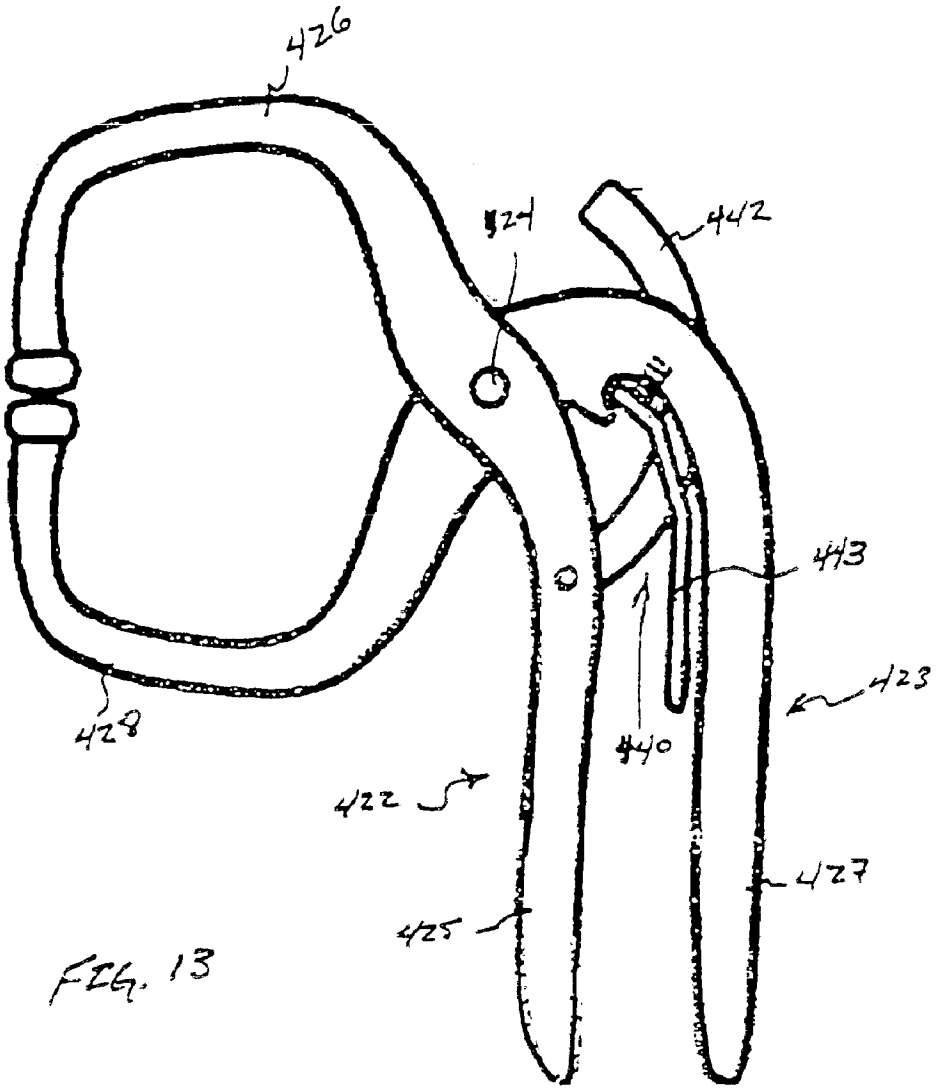
FIG. 13 is a plan view of a further embodiment of a clamp device according to the present invention.

With reference to FIG. 13, another embodiment of a clamp device generally designated 420 is illustrated. Clamp device 420 is substantially identical to the previous embodiments, including a pair of members 422, 423 pivotally connected by a pivot 424 (bolt, rivet, screw, etc.) for pivotal opposed operation (i.e. scissors like motion). Member 422 includes a handle portion 425 and a jaw portion 426. Similarly, member 423 includes a handle portion 427 and a jaw portion 428. Clamp device 420 further has a locking assembly 440 including a clamp bar 442 and a brake lever 443. The difference between this embodiment and previous embodiments is that jaw portions 426, 428 are coupled to handle portions 425, 427 at substantially right angles thereto. Thus the jaw portions extend substantially perpendicularly from pivot 424 with respect to the handle portions. Any of the variously disclosed tension systems may be employed in clamp device 420.

Figure 14:
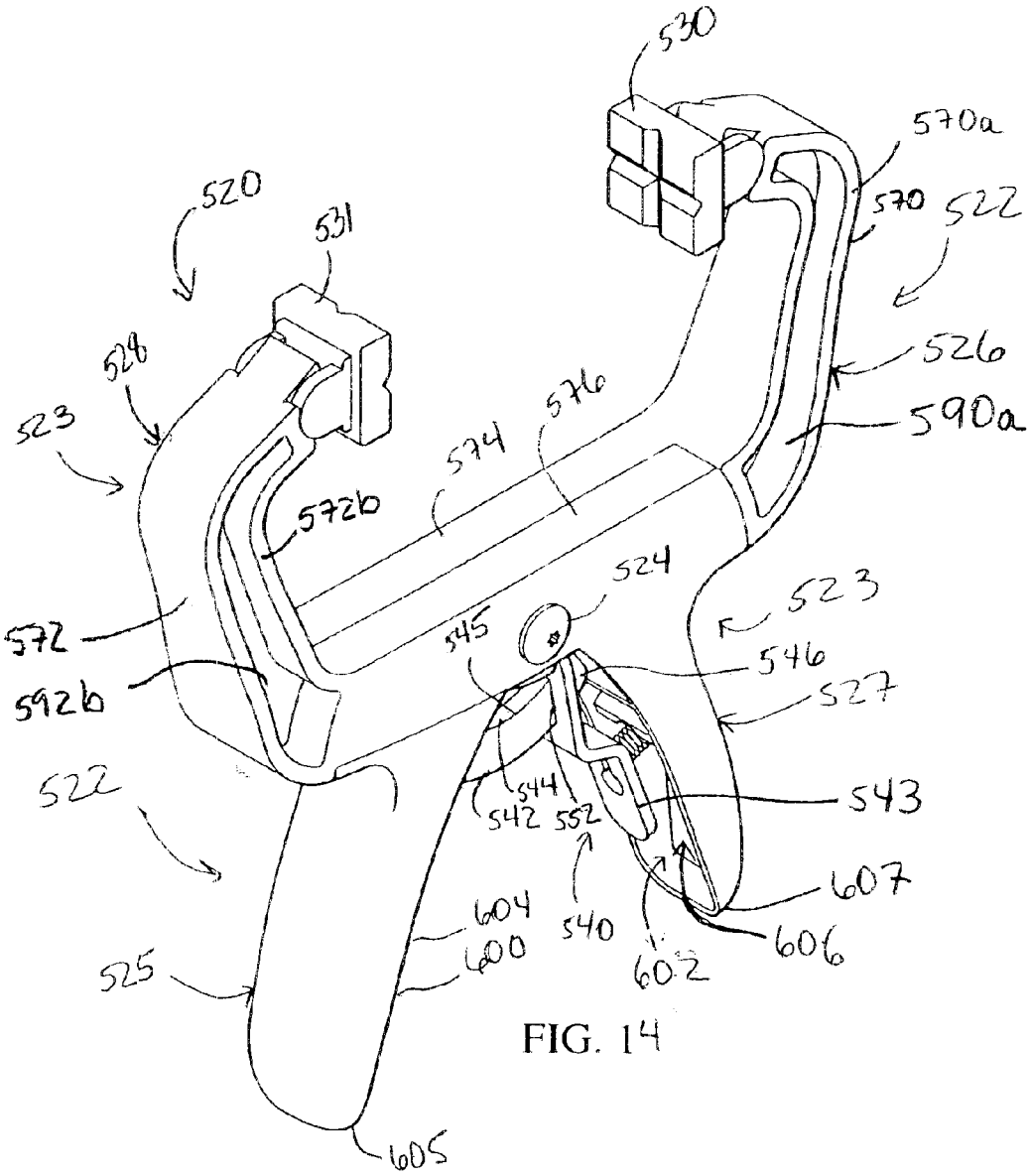
FIG. 14 is a perspective view of another embodiment of a clamp device according to the present invention.

With reference to FIG. 14, another embodiment of a clamp device generally designated 520 is illustrated in accordance with the present invention. Clamp device 520 includes a first and a second member 522, 523 pivotally connected by a pivot 524 (bolt, rivet, screw, etc.) for pivotal opposed operation. The first member 522 preferably includes a handle portion 525 and a jaw portion 526. Similarly, the second member 523 preferably includes a handle portion 527 and a jaw portion 528. Preferably, and as shown in FIG. 14, the first member 523 is made of plastic and is molded as a single piece. Even more preferably, first and second members 522, 523 are each molded as single pieces, although those skilled in the art will understand that either one or both of the members 522, 523 may be manufactured as separate pieces.

Each of the handle portions 525, 527 includes an inner surface 600, 602 that preferably defines a hollow portion 604, 606. More preferably, the hollow portions 604, 606 extend along the inner surfaces 600, 602 from an outer end 605, 607 of the handle portions 525, 527. Note that in other embodiments, the hollow portion may be defined within in one of the handle portions, and moreover, may extend to a distance less than from the outer end to approximately below the arcuate clamp bar.

A snap-fit gripping member 530 is pivotally coupled to the distal end of jaw portion 526. The distal end of jaw portion 528 also includes a snap-fit gripping member 531 pivotally coupled thereto. As with the previously described embodiments, included in this embodiment is an optional torsion spring (not shown) which is carried by pivot 524 with outwardly extending ends which engage handle portions 525 and 527 to bias the clamp device 520 into the open position illustrated in FIG. 14. The spring may be omitted, thus allowing clamp device 520 to be operated similar to conventional pliers with manual opening and closing action.

Figure 15:
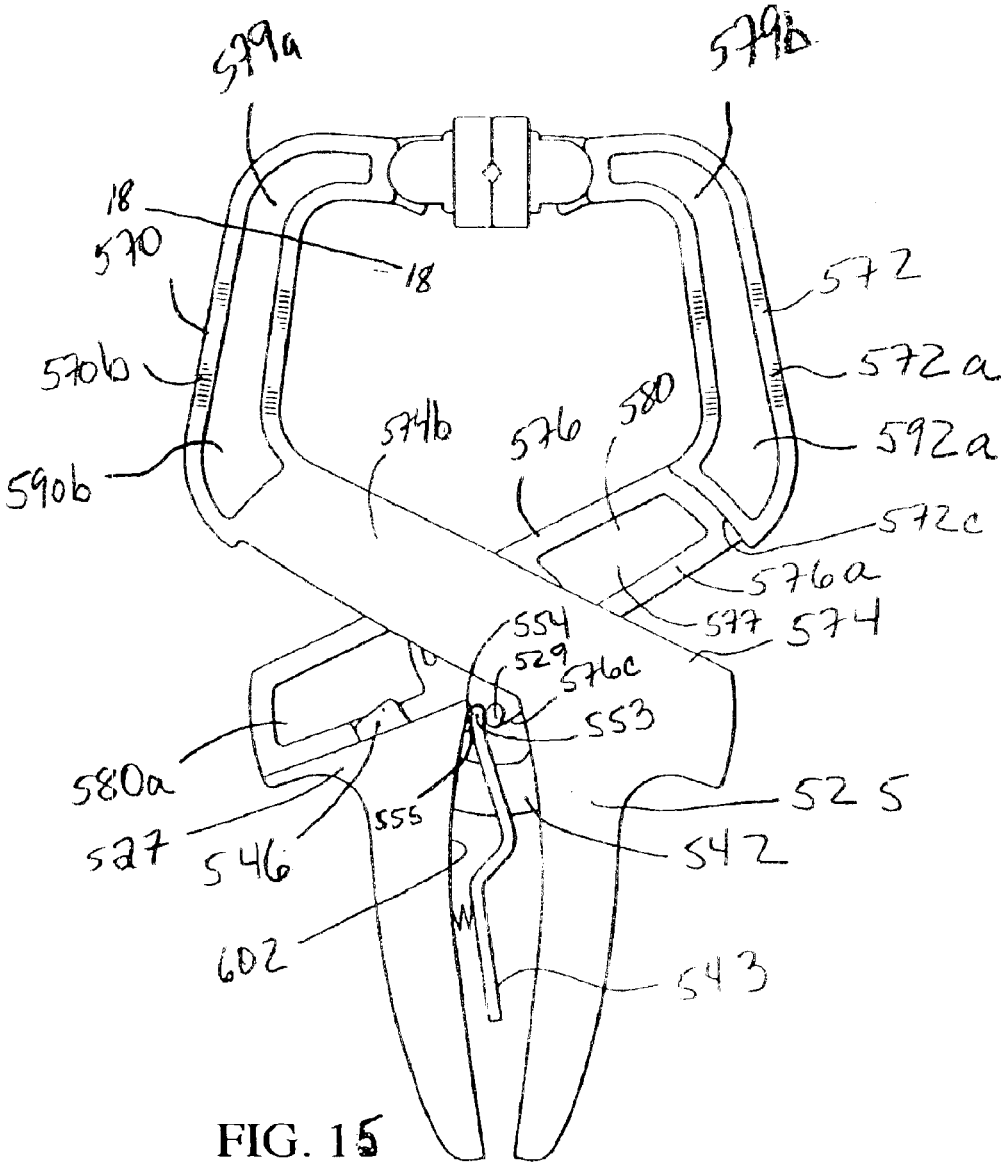
FIG. 15 is a plan view of the clamp device of FIG. 14 as it appears in the closed position.
Figure 16:
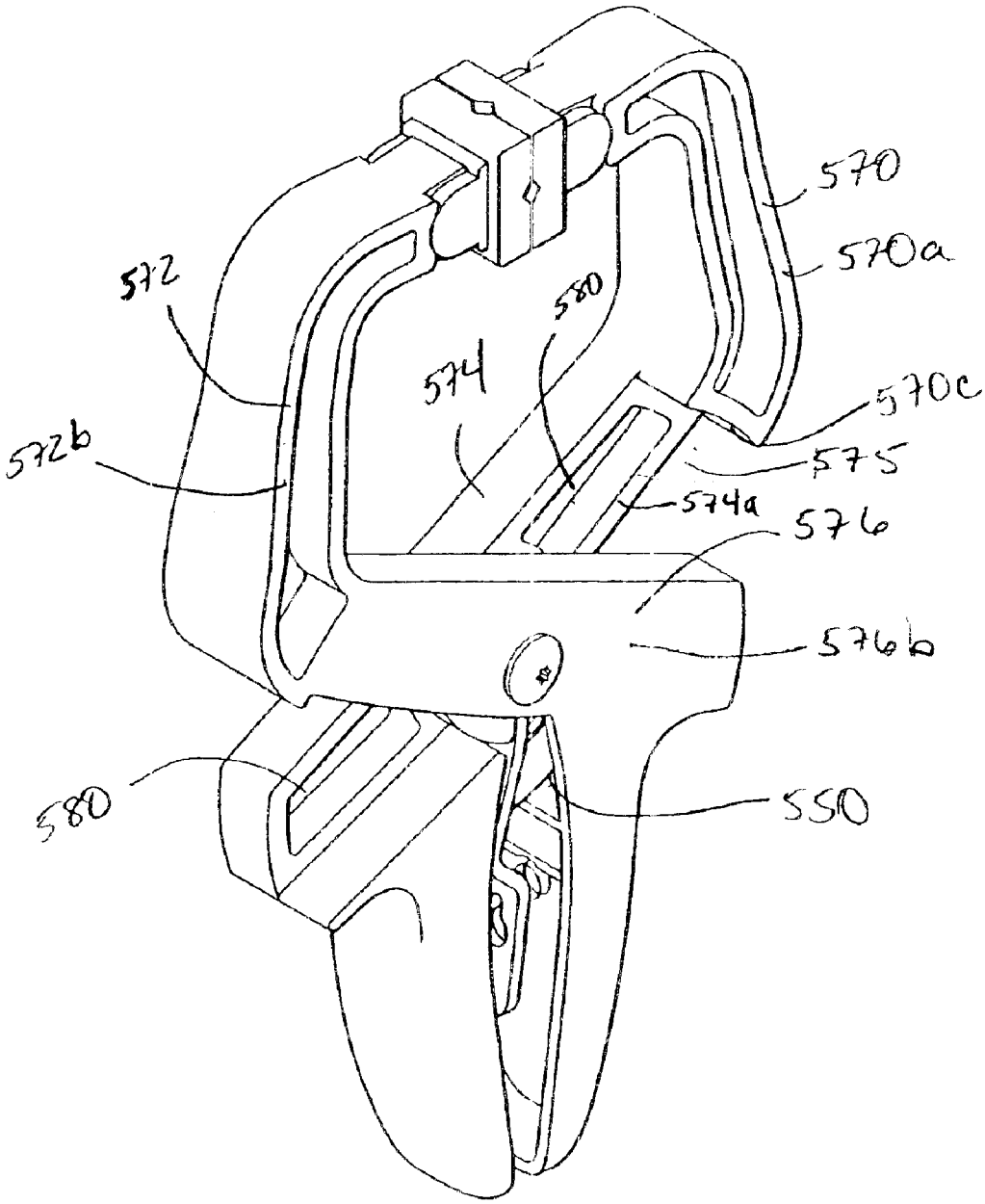
FIG. 16 is a perspective view of the clamp device of FIG. 14 as it appears in the closed position viewed from a side opposite to that of FIG. 15.

Referring to FIGS. 14 and 16, jaw portions 526, 528 each further includes a first and a second upper member 570, 572 and a first and a second truncated member 574, 576, respectively. The truncated members 574, 576 preferably are attached by the pivot 524. The upper members 570, 572 each include an inner wall 570*a*, 572*a*, an outer wall 570*b*, 572*b*, and first and second shoulders 570*c*, 572*c*, respectively (FIGS. 15 & 16). The first and second shoulders 570*c*, 572*c* are defined by the inner walls 570*a*, 572*a* and are located approximately adjacent to the truncated members 574, 576. Similarly, the truncated members 574, 576 each include an inner wall 574*a*, 576*a* and an outer wall 574*b*, 576*b*.

The first truncated member 574 is formed such that the inner wall 574*a* of the first truncated member 574 and the first shoulder 570*c* define a recess 575 within which to receive the second truncated member 576. Likewise, the second truncated member 576 is formed such that the inner wall 576*a* of the second truncated member 576 and the second shoulder 572*c* define a recess 577 within which to receive the first truncated member 574. Thus, when the clamp device 520 is in a fully open position, the outer wall 574*b* of the first truncated member 574 is substantially flush with the second upper member 572 and outer wall 576*b* of the second truncated member 576 is substantially flush with first upper member 570. Having the outer walls 574*b*, 576*b* flush with the upper members 572, 570, respectively, lends stability to the clamp device during the full range of jaw widths achieved during the open/close action of the clamp device.

Although the truncated members preferably are of the same width, those skilled in the art will readily understand that the truncated members may be of different widths so long as the outer surfaces are substantially flush with the handle portions. Thus, the presence of truncated members provides for the clamp device being of a substantially uniform thickness.

Figure 17:
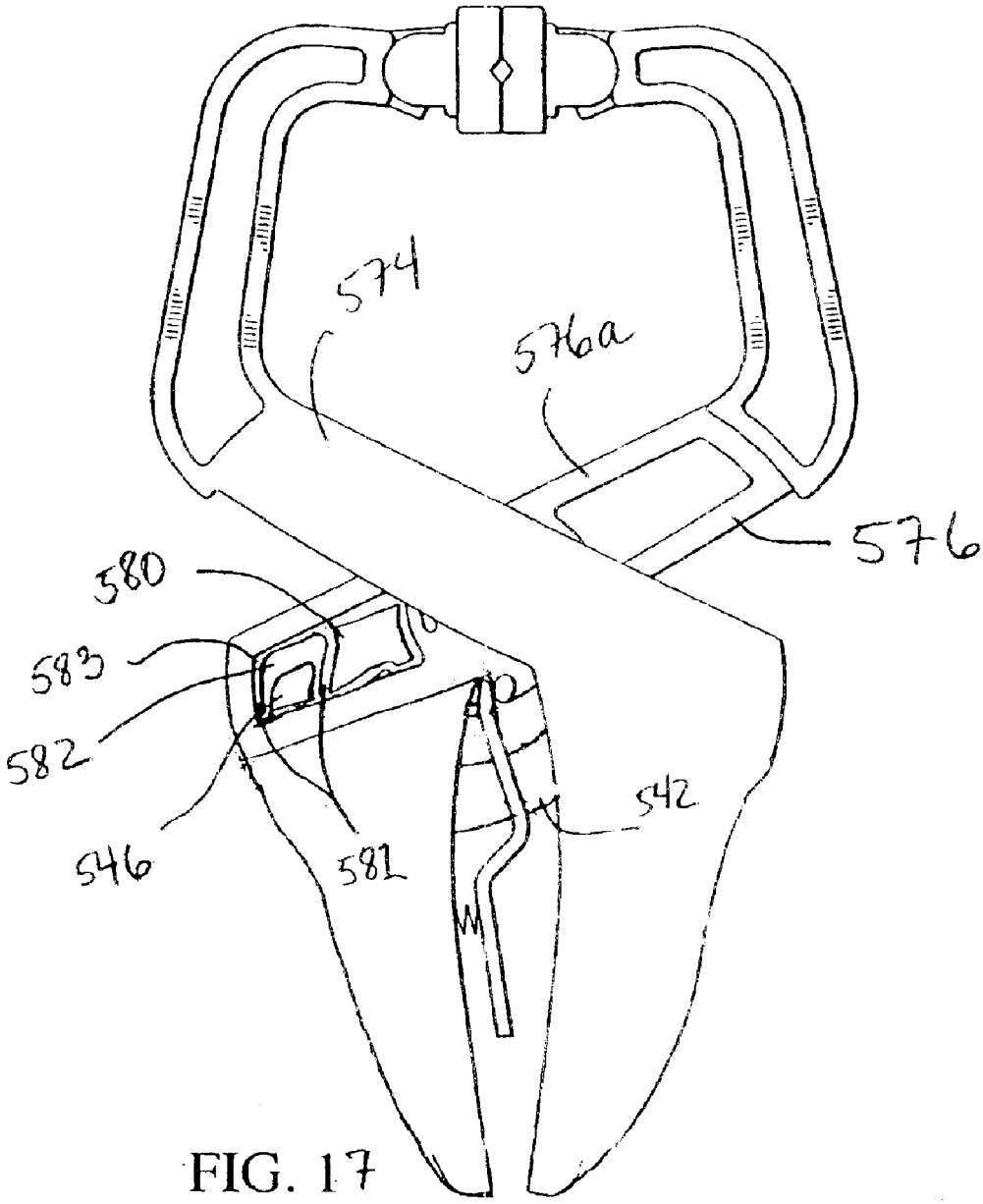
FIG. 17 is a perspective view of another embodiment of a clamp device according to the present invention.

As shown in FIGS. 15 and 16, inner walls 574*a*, 576*a* of the truncated members 574, 576 are formed to include at least one hollow portion 580. Preferably, the hollow portion 580 extends along the entire inner surface 574*a*, 576*a*, although in other embodiments the hollow surface 580 may extend along less than the entire inner surface, and moreover, need not be of equal sizes in inner surfaces 574*a*, 576*a*. In addition, and as shown in the figures, the hollow portion need not be continuous. More preferably, as shown in FIG. 17, the hollow portion 580 of second truncated member 576 includes walls 581 that define an arcuate portion 582. As will be discussed further below, the arcuate portion 582 is formed with clearance to slidably receive a clamp bar 542 when the clamp device 520 is moved into the closed position. Moreover, other internal walls may be formed to add stability to the structure of the members 522, 523.

In accordance with the present invention, and as shown in FIG. 14, clamp device 520 further includes a locking assembly 540 including a clamp bar 542 and a brake lever 543. Clamp bar 542 is an elongate arcuate design, similar to the clamp bar shown in FIG. 3, with a coupled end (not shown)

pivotally attached to handle portion 525. Examples of the pivotal attachment between the coupled end and handle portion are described in the above embodiment and may be referenced in FIGS. 1, 3, 7, and 8. It should be understood that clamp bar 542 is formed in an arcuate shape to correspond to the pivotal movement of the first and second members 522, 523, and is positioned to be substantially concentric with pivot 524. However, some variation will still allow the effective operation of the clamp device.

A top side 544 of the clamp bar 542 includes a series of ratcheting notches 545. As will be described further below, the ratcheting notches 545 engage the brake lever 543 as the clamp device 520 is moved towards the closed position.

A free end 546 of clamp bar 542 extends unhindered through a clearance aperture 550 (FIG. 16) defined in handle portion 527, thus allowing free relative movement of handle portions 525, 527. It should also be understood that aperture 550 preferably has an arcuate shape to correspond to the arcuate shape of the clamp bar 542.

Preferably, when the clamp device 520 is moved towards a closed position, which is done by engaging the handle portions 525, 527, the clamp bar extends through the aperture 550 such that the free end 546 extends past the aperture. Once the free end extends past the aperture, it is slidably received by the hollow portion 580 of second truncated member 576. The free end 546 preferably is received by an arcuate portion 582 (FIG. 17), the arcuate portion being shaped substantially similar to the arcuate shape of the clamp bar 542. In other embodiments, however, and as shown in FIG. 15, the free end 546 may be received by a hollow portion 580*a* that does not include an arcuate portion. Moreover, although FIG. 17 shows the free end 546 being received at an end 583 of the second truncated member 576, in other embodiments and as shown in FIG. 15, the free end 546 may be received at another location along the truncated member 576.

Brake lever 543 has an aperture 552 formed therethrough proximate a pivotal end 553 of the brake lever 543. Clamp bar 542 is slidably received through aperture 552. The pivotal end 553 of brake lever 543 is pivotally engaged in a notch 554. The notch 554 is formed in the general area where the jaw portion 528 and the handle portion 527 meet, proximate the pivot 524. The notch 554 extends from an inner surface 602 of the handle portion 527 and partially into a lower wall 576*c* of the second truncated member 576. Preferably, the lower wall 576*c* that forms the notch 554 includes a bearing bar 529 that is integral with and extends outwardly from the lower wall 576*c*. A compression spring 555 is positioned between the handle portion 527 and the pivotal end 553 of the brake lever.

The operation of the locking assembly 540 is as follows. The brake lever 543 generally is moveable between a frictionally engaged (locking) position and a disengaged position. When the brake lever is frictionally engaged, the spring 555 biases the brake lever 543 outwardly and away from handle portion 527 by biasing the pivotal end 553 against the bearing bar 529 so that the brake lever 543 and clamp bar 542 are frictionally engaged at aperture 552. If the handle portions 525, 527 are disengaged after being engaged to move the clamp device 520 in a closing direction, a portion of the brake lever 543 that defines the top side 547 of the aperture 552 frictionally engages a ratcheting notch 545. The handle portions 525, 527 may then be engaged again so that the frictional engagement between the ratcheting notch 545 and top side 547 is overcome, thus allowing the top side 547 and the ratcheting notch 545 to disengage. The clamp bar 543 may then continue to pass through the aperture 552. Thus, the clamp bar may be moved incrementally and provide an adjustable clamping force.

Note that because the curvature of clamp bar 542 is concentric with pivot 524, the brake lever 543 does not substantially move longitudinally when the handle portions are engaged. Upon release of the handle portions, the top side 547 and a ratcheting notch 545 again engage. Thus, the brake lever 543 may frictionally engage the clamp bar 542 and prevent the opening of the clamp bar without preventing the closing thereof.

When the brake lever is disengaged, it is moved towards the handle portion 527 and against the bias of the compression spring 555 positioned between the pivotal end 553 of the brake lever 543 and the handle portion 527. Disengaging the brake lever 543 removes the frictional engagement between the top side 547 and the ratcheting notch 545 of the clamp bar 543. If the brake lever is engaged, or released, before the clamp device reaches a fully opened position, the top side 547 will engage will a ratcheting notch 545, thus preventing the further opening of the clamp bar as described above.

The operation of the locking device described above is conveniently accomplished through the use of one hand. To clamp an object, the handle portions 525, 527 are squeezed until the jaw portions 526, 528 clamp an object a desired amount. As noted above, the amount of clamping force may be adjusted. After the handles are released, they may be squeezed further to provide a greater force on an object. To disengage the brake lever 543, it may be squeezed towards the handle portion 527.

In addition to the above-described features associated with the locking device, the clamp device of FIGS. 14-17 optionally may include a latch similar to that described in the above embodiments.

Figure 18:
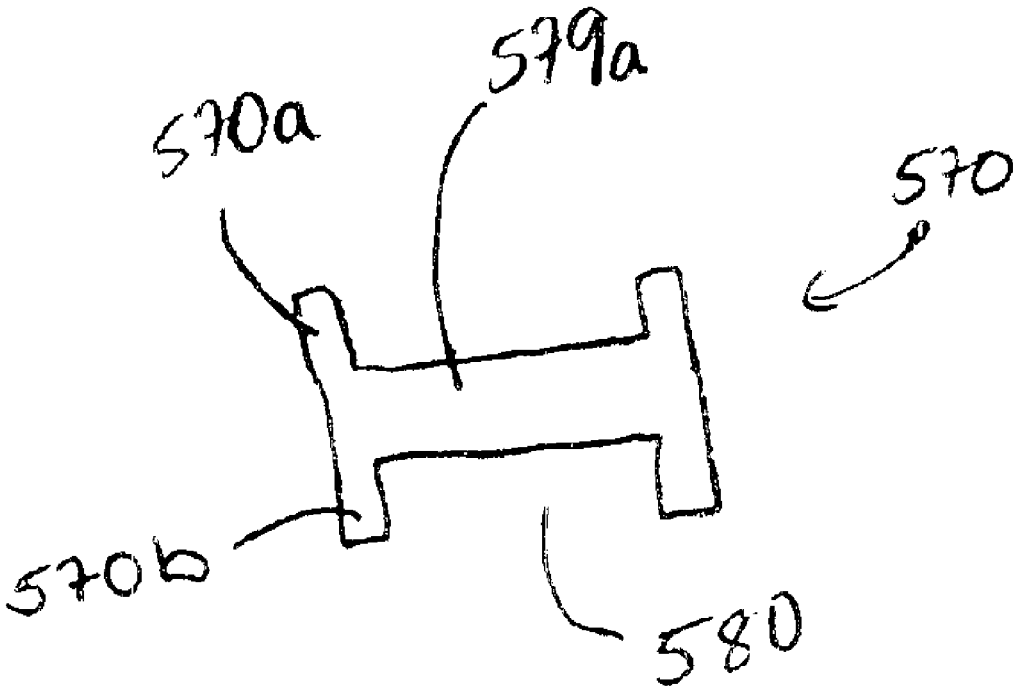
FIG. 18 is a partial cross-sectional view of the clamp device of FIG. 15, taken along the line 18—18.

Preferably, the upper members 570, 572 also include web walls 579*a*, 579*b*. Referring to FIG. 18, which shows a portion of upper member 570, the web wall 579*a* and the inner and outer walls 570*a*, 570*b* are formed such that the upper member 570 has an I-beam shape when viewed in cross section. The second upper member 572 is similarly formed.

The web walls 579*a*, 579*b* preferably extend along the entirety of the upper members 570, 572. In other embodiments, however, the web walls may extend along less than the entirety of the upper members. Moreover, additional web walls may be formed to add stability to the structure of the upper members 570, 572. As shown in FIGS. 14 and 15, the web walls 579*a*, 579*b* and the inner and outer surfaces, 570*a*, 572*a*, 570*b*, 572*b* define hollow portions 590*a*, 592*a*, 590*b*, and 592*b*, respectively, which extend along the upper members 570, 572.

Similarly, and as noted above, the inner walls 574*a*, 576*a* of the truncated members 574, 576 each includes the hollow portion 580. Although the preferred embodiment does not include a hollow portion on each of the outer walls of the truncated members, in other embodiments, the outer wall of each truncated member may each include a hollow portion. Optionally, the hollow portions on the outer walls may extend along a part or the entirety of the outer surface. Moreover, the hollow portions may be present along one or both of the outer walls. In addition, the hollow portion on the inner surface of the first truncated member (i.e., the inner surface that does not slidably receive the clamp bar), may extend along a portion or the entirety of the inner surface, and in other embodiments need not be present at all.

Thus, the hollowed portions of the upper members and truncated members provide the advantage of a lighter-weight clamp device.

As with the previously described embodiments of FIGS. 1–10, clamp device 520 is preferably formed of a flexible material such as plastic. While rigid materials such as metal may be employed, the clamping operation will not be as effective unless the metal is flexible. By flexing in an outward direction under pressure from the item being clamped, the jaw portions 526, 528 of members 522, 523 form a tension system which permits a tight clamping action by their bias in the inward direction. In the same manner, the handle portions 525, 527 of the members flex in an inward direction as compression is applied, and bias outwardly upon release of the compression force, placing pressure upon the jaw portions. Moreover, with respect to the upper members, the hollowed portions, as defined by the inner and outer walls and the web walls, provide improved flexibility and a greater stability during flexing over solidly formed members. The presence of the hollowed portions of the upper members also assist in the tensioning previously described during clamping, allowing the upper members to attain a "spring-like" action when an object is being clamped.

Various changes and modifications to the embodiments herein chosen for purposes of illustration will readily occur to those skilled in the art. For example, while the arcuate clamp bars in the above embodiments are illustrated coupled at one end by a pin, it will be understood that the clamp bars may be coupled by being integrally formed with one of the handle portions, adhered thereto or welded, etc. By way of further example, the ratcheting members may formed on a bottom side, opposite the top side, of the clamp bar 542, and may frictionally engage with a portion of brake lever 543 that defines the bottom side of the aperture 552. The extent that such modifications and variations do not depart from the spirit of the invention and are intended to be included within the scope thereof which is assessed only by a fair interpretation of the claims.

What is claimed is:

1. A clamp device comprising:

a first member having a handle portion and a jaw portion;

a second member having a handle portion and a jaw portion, wherein the handle portion and jaw portion of the second member define a notch extending from an inner surface of the handle portion of the second member at least partially into the jaw portion of the second member, the second member being formed as a single piece;

a pivot pivotally coupling the first member and the second member intermediate their respective handle portion and jaw portion for opposed pivotal motion;

the notch being proximate the pivot;

an arcuate clamp bar having a first end coupled to the first member and a second end, an arc of the arcuate clamp bar being concentric with the pivot; and a brake lever having an end pivotally coupled to the second member at the notch, the end contacting the jaw portion of the second member, the brake lever having an aperture with the arcuate clamp bar extending therethrough, the brake lever movable laterally between a frictionally engaged position, frictionally engaging the arcuate clamp bar and a disengaged position.

2. The clamp device of claim 1, wherein the jaw portion further includes a bearing bar, the notch being defined in part by the bearing bar.

3. The clamp device of claim 2, wherein an end of the brake lever is pivotally coupled to the second member by being disposed within the notch, the end of the brake lever pivoting against the bearing bar.

4. The clamp device of claim 3, further comprising a spring positioned between the handle portion of the second member and the end of the brake lever, the spring biasing the end of the brake lever against the bearing bar.

5. The clamp device of claim 1, wherein the second end of the arcuate clamp bar extends into an aperture in the handle portion of the second member, the aperture being arcuately shaped.

6. The clamp device of claim 1 wherein the jaw portion of the first member includes a first upper member and a first truncated member and the jaw portion of the second member includes a second upper member and a second truncated member, the first and the second upper members and the first and the second truncated members each further including an inner wall and an outer wall.

7. The clamp device of claim 6, wherein the inner wall of the first upper member defines a first shoulder adjacent the first truncated member, and wherein the inner wall of the second upper member defines a second shoulder adjacent the second truncated member.

8. The clamp device of claim 7 wherein the inner wall of the first truncated member and the first shoulder define a first recess, and wherein the inner wall of the second truncated member and the second shoulder define a second recess, the first recess receiving the second truncated member such that the second truncated member is substantially flush with the first upper member and the second recess receiving the first truncated member such that the first truncated member is substantially flush with the second upper member.

9. The clamp device of claim 6 wherein the inner wall of at least one of the truncated members is each formed to define at least one hollow portion that extends along at least a portion of the inner wall.

10. The damp device of claim 9 wherein the inner wall of the second truncated member further defines a hollow portion extending along at least a portion of the inner wall, the hollow portion adapted to slidably receive the arcuate clamp bar.

11. The clamp device of claim 10 wherein the hollow portion includes an arcuate portion to slidably receive the arcuate clamp bar, the arcuate portion shaped to be concentric with the arcuate clamp bar.

12. The clamp device of claim 6, wherein at least one of the upper members further comprises a web wall that extends along at least a portion of the at least one of the upper members, the web wall and the inner and outer walls of the at least one of the upper members defining hollow portions in the at least one of the upper members.

13. The clamp device of claim 1, wherein the first member is formed as a single piece.

14. The clamp device of claim 1, wherein a top side of the clamp bar further includes a series of ratcheting notches for engagement with a portion of the brake lever that defines a top side of the aperture.

15. The clamp device of claim 1, wherein a bottom side of the clamp bar further includes a series of ratcheting notches for engagement with a portion of the brake lever that defines a bottom side of the aperture.

16. A clamp device comprising:

a first member having a handle portion and a jaw portion;

a second member having a handle portion and a jaw portion, wherein the handle portion and the jaw portion of the second member define a notch extending from an inner surface of the handle portion of the second member at least partially into the jaw portion of the second member, the notch having inner surfaces integral with the second member;

a pivot pivotally coupling the first member and the second member intermediate their respective handle portion and jaw portion for opposed pivotal motion;

the notch being proximate the pivot;

an arcuate clamp bar having a first end coupled to the first member and a second end, an arc of the arcuate clamp bar being concentric with the pivot; and a brake lever having an end pivotally disposed within the notch, the brake lever pivoting against an inner surface of the notch in the jaw portion of the second member, and having an aperture with the arcuate clamp bar extending therethrough, the brake lever movable laterally between a frictionally engaged position, frictionally engaging the arcuate clamp bar and a disengaged position, and substantially motionless longitudinally.

17. The clamp device of claim 16 further comprising a spring positioned between the handle portion of the second member and the end of the brake lever, the spring biasing the end of the brake lever against the inner surface of the notch.

18. The clamp device of claim 16 wherein the jaw portion of the first member includes a first upper member and a first truncated member and the jaw portion of the second member includes a second upper member and a second truncated member, the first and the second upper members and the first and the second truncated members each further including an inner wall and an outer wall.

19. The clamp device of claim 18, wherein the inner wall of the first upper member defines a first shoulder adjacent the first truncated member, and wherein the inner wall of the second upper member defines a second shoulder adjacent the second truncated member.

20. The clamp device of claim 19 wherein the inner wall of the first truncated member and the first shoulder define a first recess, and wherein the inner wall of the second truncated member and the second shoulder define a second recess, the first recess for receiving the second truncated member such that the second truncated member is substantially flush with the first upper member and the second recess for receiving the first truncated member such that the first truncated member is substantially flush with the second upper member.

21. The clamp device of claim 18, wherein at least one of the upper members further comprises a web wall that extends along at least a portion of the at least one of the upper members, the web wall and the inner and outer walls of the at least one of the upper members defining hollow portions in the at least one of the upper members.

22. The clamp device of claim 16, wherein a top side of the clamp bar further includes a series of ratcheting notches for engagement with a portion of the brake lever that defines a top side of the aperture.

23. The clamp device of claim 16, wherein a bottom side of the clamp bar further includes a series of ratcheting notches for engagement with a portion of the brake lever that defines a bottom side of the aperture.

24. A clamp device comprising:

a first member having a handle portion and a jaw portion, the jaw portion including a first upper member and a first truncated member each having an inner wall and a first shoulder defined by the inner wall of the first upper member and adjacent the first truncated member;

a second member having a handle portion and a jaw portion, the jaw portion including a second upper member and a second truncated member each having an inner wall and a second shoulder defined by the inner wall of the second upper member and adjacent the second truncated member, the second truncated member having a notch defined thereon;

a first recess defined by the inner wall of the first truncated member and the first shoulder, the first recess for receiving the second truncated member such that the second truncated member is substantially flush with the first upper member;

a second recess defined by the inner wall of the second truncated member and the second shoulder, the second recess for receiving the first truncated member such that the first truncated member is substantially flush with the second upper member;

a pivot pivotally coupling the first member and the second member intermediate their respective handle portion and jaw portion for opposed pivotal motion;

the notch of the second truncated member being proximate the pivot;

an arcuate clamp bar having a first end coupled to the first member at the notch, and a second end, an arc of the arcuate clamp bar being concentric with the pivot; and a brake lever having an end contacting the second truncated member and having an aperture with the arcuate clamp bar extending therethrough, the brake lever being movable laterally between a frictionally engaged position engaging the arcuate clamp bar and a disengaged position.

25. The clamp device of claim 24 wherein the end of the brake lever is pivotally coupled to the second truncated member.

26. The clamp device of claim 25, wherein the second truncated member further includes a bearing bar, the notch being defined in part by the bearing bar.

27. The clamp device of claim 26, further comprising a spring positioned between the handle portion of the second member and the end of the brake lever, the spring biasing the end of the brake lever against the bearing bar.

28. The clamp device of claim 24, wherein the second end of the arcuate clamp bar extends into an aperture in the handle portion of the second member, the aperture being arcuately shaped.

29. The clamp device of claim 24, wherein at least one of the upper members further comprises a web wall that extends along at least a portion of the at least one of the upper members, the web wall and the inner and outer walls of the at least one of the upper members defining hollow portions in the at least one of the upper members.

30. The clamp device of claim 24, wherein the first member is formed as a single piece and the second member is formed as a single piece.

31. The clamp device of claim 24, wherein a top side of the clamp bar further includes a series of ratcheting notches for engagement with a portion of the brake lever that defines a top side of the aperture.

32. The clamp device of claim 24, wherein a bottom side of the clamp bar further includes a series of ratcheting notches for engagement with a portion of the brake lever that defines a bottom side of the aperture.

33. A clamp device comprising:

a first member having a handle portion and a jaw portion, the jaw portion including a first upper member having an inner wall, an outer wall and a web wall that extends along at least a portion of the first upper member, the inner wall, the outer wall and the web wall defining hollow portions in the first upper member;

a second member having a handle portion and a jaw portion, the jaw portion including a second upper member having an inner wall, an outer wall and a web wall that extends along at least a portion of the second upper member, the inner wall, the outer wall and the web wall defining hollow portions in the second upper member, the second member having a notch defined thereon;

a pivot pivotally coupling the first member and the second member intermediate their respective handle portion and jaw portion for opposed pivotal motion;

the notch being proximate the pivot;

an arcuate clamp bar having a first end coupled to the first member, the arcuate clamp bar being concentric with the pivot; and a brake lever having an end contacting the jaw portion of the second member at the notch and having an aperture with the arcuate clamp bar extending therethrough, the brake lever being movable laterally between a frictionally engaged position engaging the arcuate clamp bar and a disengaged position.

34. The clamp device of claim 33 wherein the end of the brake lever is pivotally coupled to the jaw portion of the second member.

35. The clamp device of claim 34, wherein the jaw portion of the second member further includes a bearing bar, the notch being defined in part by the bearing bar.

36. The clamp device of claim 35, further comprising a spring positioned between the handle portion of the second member and the end of the brake lever, the spring biasing the end of the brake lever against the bearing bar.

37. The clamp device of claim 33 wherein the jaw portion of the first member further includes a first truncated member and the jaw portion of the second member further includes a second truncated member, the first and the second truncated members each having an inner wall and an outer wall.

38. The clamp device of claim 37, wherein the inner wall of the first upper member defines a first shoulder adjacent the first truncated member, and wherein the inner wall of the second upper member defines a second shoulder adjacent the second truncated member.

39. The clamp device of claim 38 wherein the inner wall of the first truncated member and the first shoulder define a first recess, and wherein the inner wall of the second truncated member and the second shoulder define a second recess, the first recess receiving the second truncated member such that the second truncated member is substantially flush with the first upper member and the second recess receiving the first truncated member such that the first truncated member is substantially flush with the second upper member.

40. The clamp device of claim 33, wherein the first member is formed as a single piece and wherein the second member is formed as a single piece.

41. The clamp device of claim 33, wherein a top side of the clamp bar further includes a series of ratcheting notches for engagement with a portion of the brake lever that defines a top side of the aperture.

42. The clamp device of claim 33, wherein a bottom side of the clamp bar further includes a series of ratcheting notches for engagement with a portion of the brake lever that defines a bottom side of the aperture.

* * * * *